US011037721B2

(12) United States Patent
Choi et al.

(10) Patent No.: US 11,037,721 B2
(45) Date of Patent: Jun. 15, 2021

(54) POWER INDUCTOR AND METHOD OF MANUFACTURING THE SAME

(71) Applicant: SAMSUNG ELECTRO-MECHANICS CO., LTD., Suwon-si (KR)

(72) Inventors: Youn Kyu Choi, Suwon-si (KR); Hea Ah Kim, Suwon-si (KR); Jae Yeol Choi, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 234 days.

(21) Appl. No.: 15/969,225

(22) Filed: May 2, 2018

(65) Prior Publication Data

US 2018/0247755 A1 Aug. 30, 2018

Related U.S. Application Data

(63) Continuation of application No. 14/983,310, filed on Dec. 29, 2015, now Pat. No. 9,984,812.

(30) Foreign Application Priority Data

Jan. 27, 2015 (KR) ..... 10-2015-0012579

(51) Int. Cl.
*H01F 27/29* (2006.01)
*H01F 17/00* (2006.01)
(Continued)

(52) U.S. Cl.
CPC ..... *H01F 27/292* (2013.01); *H01F 17/0013* (2013.01); *H01F 27/255* (2013.01); *H01F 41/041* (2013.01); *H01F 41/046* (2013.01)

(58) Field of Classification Search
CPC ..... H01F 27/292; H01F 17/0013
See application file for complete search history.

(56) References Cited

U.S. PATENT DOCUMENTS 6,373,368 B1 4/2002 Shikama et al.
8,975,997 B2 3/2015 Tonoyama et al.
(Continued)

FOREIGN PATENT DOCUMENTS

JP H08330106 A 12/1996
JP H09-283359 A 10/1997
(Continued)

OTHER PUBLICATIONS

Non-Final Office Action issued in U.S. Appl. No. 14/983,310, dated Mar. 13, 2017.
(Continued)

*Primary Examiner* — Elvin G Enad
*Assistant Examiner* — Malcom Barnes
(74) *Attorney, Agent, or Firm* — Morgan, Lewis & Bockius LLP

(57) ABSTRACT

A power inductor includes a substrate having a through hole in a central portion thereof; a first internal coil pattern and a second internal coil pattern each having a spiral shape and provided on opposite surfaces of the substrate outwardly of the through hole; a magnetic body enclosing the substrate on which the first internal coil pattern and the second internal coil pattern are provided, end portions of the first internal coil pattern and the second internal coil pattern being exposed to opposite end surfaces thereof; a first external electrode and a second external electrode provided on the opposite end surfaces of the magnetic body to be connected to the end portions of the first internal coil pattern and the second internal coil pattern, respectively; and an anti-plating
(Continued)

layer covering the magnetic body between the first external electrode and the second external electrode.

6 Claims, 1 Drawing Sheet

(51) Int. Cl.
*H01F 27/255* (2006.01)
*H01F 41/04* (2006.01)

(56) References Cited

U.S. PATENT DOCUMENTS

2002/0014280 A1 2/2002 Moro
2002/0053967 A1* 5/2002 Shikama ..... H01F 41/04 336/83
2003/0099085 A1 5/2003 Duva
2004/0074564 A1 4/2004 Brunner
2005/0012652 A1* 1/2005 Wakayama ..... H01F 1/18 342/1
2006/0152321 A1 7/2006 Jung et al.
2009/0091412 A1 4/2009 Shin et al.
2011/0002082 A1 1/2011 Bultitude et al.
2011/0222206 A1 9/2011 Komatsu et al.
2012/0212919 A1 8/2012 Mano et al.
2012/0234462 A1* 9/2012 Matsui ..... H05K 3/0058 156/89.12
2012/0274432 A1* 11/2012 Jeong ..... H01F 17/0033 336/192
2013/0113593 A1* 5/2013 Jeong ..... H01F 27/292 336/200
2013/0147591 A1* 6/2013 Kim ..... H01F 41/00 336/200
2013/0169401 A1* 7/2013 Lee ..... H01F 41/10 336/192
2013/0222101 A1* 8/2013 Ito ..... H01F 5/003 336/83
2013/0249662 A1 9/2013 Tonoyama et al.
2013/0255071 A1* 10/2013 Muneuchi ..... H01F 27/292 29/605
2013/0293334 A1* 11/2013 Shin ..... H01F 17/0033 336/192
2014/0002226 A1* 1/2014 Moon ..... H01F 27/292 336/200
2014/0009254 A1* 1/2014 Ohkubo ..... H01F 27/29 336/192
2014/0022042 A1* 1/2014 Park ..... H01F 17/0013 336/200
2014/0145812 A1 5/2014 Lee et al.
2014/0184374 A1 7/2014 Park et al.
2015/0325369 A1 11/2015 Inoue et al.
2016/0314890 A1* 10/2016 Kitajima ..... H01F 27/292
2016/0322171 A1* 11/2016 Saeki ..... H01G 9/052
2017/0084376 A1* 3/2017 Kubota ..... C09K 13/08

FOREIGN PATENT DOCUMENTS

JP 2000-31772 A 1/2001
JP 2001-155950 A 6/2001
JP 2005-510049 A 4/2005
JP 2006-310716 A 11/2006
JP 2010-186909 A 8/2010
JP 2012-186440 A 9/2012
JP 2013-225718 A 10/2013
JP 2013225718 A * 10/2013
JP 2014-63923 A 4/2014
JP 2014-107548 A 6/2014
JP 2014-130988 A 7/2014
JP 2016-58418 A 4/2016
KR 10-1280507 B1 7/2013
KR 10-2013-0109047 A 10/2013
WO 2014/119564 A1 8/2014
WO 2016/013643 A1 1/2016

OTHER PUBLICATIONS

Final Office Action issued in U.S. Appl. No. 14/983,310, dated Sep. 21, 2017.
Notice of Allowance issued in U.S. Appl. No. 14/983,310, dated Jan. 31, 2018.
Office Action issued in Japanese Application No. 2015-230981 dated Oct. 23, 2018, with English translation.
Office Action issued in corresponding Korean Application No. 10-2015-0012579 dated Aug. 21, 2019, with English translation.

* cited by examiner

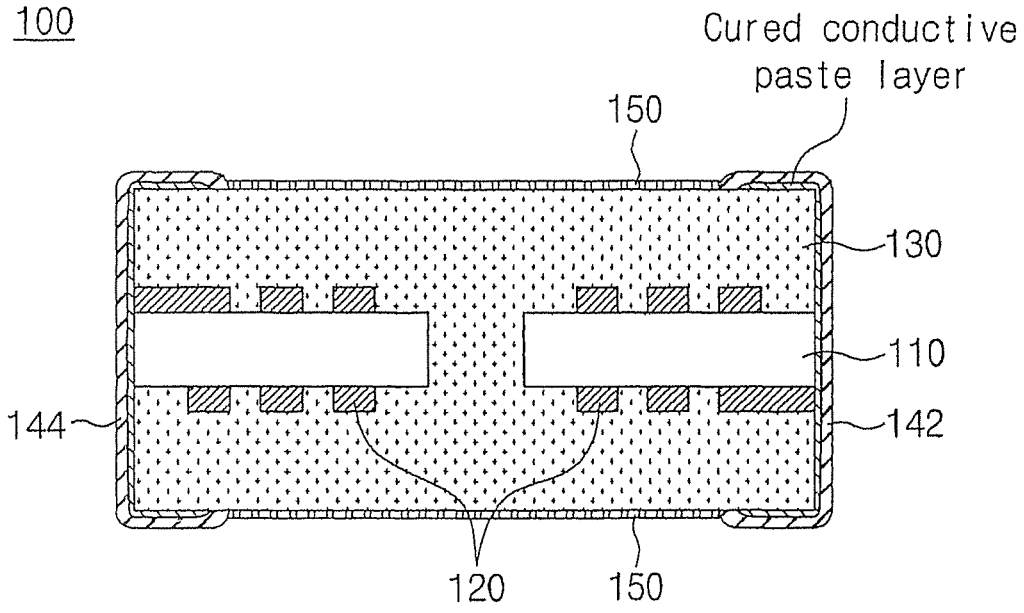
100
Cured conductive paste layer
150
130
110
144
142
120
150

POWER INDUCTOR AND METHOD OF MANUFACTURING THE SAME

CROSS-REFERENCE TO RELATED APPLICATION

This application is a continuation of U.S. patent application Ser. No. 14/983,310, filed Dec. 29, 2015 which claims the benefit of priority to Korean Patent Application No. 10-2015-0012579, filed on Jan. 27, 2015 with the Korean Intellectual Property Office. The subject matter of each is incorporated herein by reference in entirety.

BACKGROUND

The present disclosure relates to a power inductor and a method of manufacturing the same and, more particularly, to a power inductor in which a degradation of reliability may be prevented and a method of manufacturing the same.

Inductors are coil components commonly used as electronic components in cellular phones and personal computers (PCs). Inductors generate inductive electromotive force in response to changes in magnetic flux. This phenomenon is commonly known as inductance, and in this regard, inductance increases in proportion to a cross-sectional area of a core of an inductor, the number of turns of a wire, and magnetic permeability of a coil.

As electronic components, inductors are commonly divided into wire wound inductors, multilayer inductors, and thin film inductors, according to methods of manufacturing thereof. In particular, power inductors are electronic components performing power smoothing or noise cancelation in a power terminal of a central processing unit (CPU), or the like. As a power inductor allowing a large amount of current to flow therein, a wire wound inductor is largely used. A wire wound inductor commonly has a structure in which a copper (Cu) wire is wound around a ferrite drum core. Thus, since a high magnetic permeability/low loss ferrite core is used, the inductor may have high inductance while being compact.

In addition, such a high magnetic permeability/low loss ferrite core can obtain the same amount of inductance, even when the number of turns of a copper wire is low and direct current (DC) resistance (Rdc) of the copper wire is also low, contributing to a reduction in battery power consumption.

A multilayer inductor is largely used in a filter circuit or in an impedance matching circuit of a signal line. The multilayer inductor is manufactured by printing a coil pattern containing a metal such as silver (Ag) as paste on ferrite sheets, and stacking the same. Multilayer inductors were commercialized globally in the 1980s. Starting from a multilayer inductor employed as a surface mounted device (SMD) for portable radios, multilayer inductors have commonly been used in various electronic devices. Since multilayer inductors have a structure in which ferrite covers a three-dimensional coil, magnetic leakage rarely occurs due to a magnetic shielding effect of ferrite, and multilayer inductors are appropriate for high density mounting in circuit boards.

SUMMARY

An exemplary embodiment in the present disclosure may provide a power inductor having reliability through the prevention of spreading of a plating solution during a plating operation for forming external electrodes, and a method of manufacturing the same.

According to an exemplary embodiment in the present disclosure, a power inductor may include: a substrate having a through hole in a central portion thereof; a first internal coil pattern and a second internal coil pattern each having a spiral shape and provided on opposite surfaces of the substrate outwardly of the through hole; a magnetic body enclosing the substrate on which the first internal coil pattern and the second internal coil pattern are provided, end portions of the first internal coil pattern and the second internal coil pattern being exposed to opposite end surfaces thereof; a first external electrode and a second external electrode provided on the opposite end surfaces of the magnetic body to be connected to the end portions of the first internal coil pattern and the second internal coil pattern, respectively; and an anti-plating layer covering the magnetic body between the first external electrode and the second external electrode.

The substrate may include an insulating material or a magnetic material.

The magnetic body may include a ferrite or a metal-polymer composite. The metal-polymer composite may include metal particles having a diameter ranging from 100 nm to 90 μm, and a polymer in which metal particles are dispersed. The metal particles may be covered with a phosphate insulating layer. The polymer may include an epoxy, a polyimide, or a liquid crystal polymer.

Each of the first external electrode and the second external electrode may include a cured conductive paste layer connected to the first internal coil pattern or the second internal coil pattern; and a plating layer plated on the cured conductive paste layer. The cured conductive paste layer may include silver. The plating layer may include nickel or tin. The anti-plating layer may further cover a portion of the cured conductive paste layer.

The anti-plating layer may include an organic-inorganic hybrid composite including an inorganic silica sol and an organic silane coupling agent. The inorganic silica sol may be prepared by hydrolyzing and condensation-polymerizing silica with tetraethylorthosilicate.

According to an exemplary embodiment in the present disclosure, a method of manufacturing a power inductor may include steps of: preparing a substrate having a through hole in a central portion thereof; forming a first internal coil pattern and a second internal coil pattern each having a spiral shape on opposite surfaces of the substrate outwardly of the through hole; forming a magnetic body enclosing the substrate on which the first internal coil pattern and the second internal coil pattern are formed, the end portions of the first internal coil pattern and the second internal coil pattern being exposed to opposite end surfaces thereof; forming an anti-plating layer to cover a portion of the magnetic body between the end surfaces of the magnetic body, the anti-plating layer not covering the end portions of the first internal coil pattern and the second internal coil pattern; and forming a first external electrode and a second external electrode on the end surfaces of the magnetic body to be connected to the end portions of the first internal coil pattern and the second internal coil pattern.

The magnetic body may include a ferrite or a metal-polymer composite. The metal-polymer composite may include metal particles having a diameter ranging from 100 nm to 90 μm, and a polymer in which metal particles are dispersed. The metal particles may be covered with a phosphate insulating layer. The polymer may include an epoxy, a polyimide, or a liquid crystal polymer.

The step of forming the anti-plating layer and the step of forming the first external electrode and the second external electrode may further include: forming a cured conductive paste layer on the end surfaces of the magnetic body to be connected to the end portions of the first internal coil pattern and the second internal coil pattern; forming the anti-plating layer to cover a portion of the magnetic body on which the cured conductive paste layer is not formed; and forming a plating layer on the cured conductive paste layer.

The cured conductive paste layer may be formed by coating the end surfaces of the magnetic body with a silver paste and subsequently curing the silver paste.

The plating layer may be formed by plating the cured conductive paste layer with nickel or tin.

The anti-plating layer may be formed to further cover a portion of the cured conductive paste layer.

The anti-plating layer may include an organic-inorganic hybrid composite including an inorganic silica sol and an organic silane coupling agent. The inorganic silica sol may be formed by hydrolyzing and condensation-polymerizing silica with tetraethylorthosilicate. The organic-inorganic hybrid composite may have a pH level of 4 to 6. The organic silane coupling agent may have a molarity of 0.09 to 0.14 mol/l.

BRIEF DESCRIPTION OF DRAWINGS

The above and other aspects, features and advantages of the present disclosure will be more clearly understood from the following detailed description taken in conjunction with the accompanying drawings.

FIG. 1 is a cross-sectional view schematically illustrating a power inductor according to an exemplary embodiment in the present disclosure.

DETAILED DESCRIPTION

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

FIG. 1 is a cross-sectional view schematically illustrating a power inductor according to an exemplary embodiment of the present disclosure.

Referring to FIG. 1, a power inductor 100 includes a substrate 110 having a through hole formed in a central portion thereof, first and second internal coil patterns 120 provided on opposing surfaces of the substrate outside the through hole, a magnetic body 130 enclosing the substrate 110 provided with the first and second internal coil patterns 120 while allowing end portions of the first and second internal coil patterns to be exposed to end surfaces of the magnetic body 130 opposing each other, a first external electrode 142 and a second external electrode 144 provided on both end surfaces of the magnetic body 130 and connected to end portions of the first and second internal coil patterns 120, and an anti-plating layer 150 covering the magnetic body 130 between the first external electrode 142 and the second external electrode 144.

The power inductor 100 according to an exemplary embodiment in the present disclosure is described as a thin film power inductor, for example, but a type of power inductor is not limited thereto. The power inductor 100 may undertake the functions of other electronic components, such as capacitors and thermistors, through a structure of the internal coil patterns 120 being differentiated and the application of the anti-plating layer 150 according to the exemplary embodiment in the present disclosure.

The substrate 110 having a through hole in a central portion thereof is prepared. The substrate 110 may include an insulating material or a magnetic material. When the substrate includes a magnetic material, the substrate 110 may serve to both maintain and enhance magnetic properties within the power inductor 100. The through hole of the substrate 110 is filled with the magnetic body 130 and used as a core of the power inductor 100, and thus, the power inductor 100 may have a high degree of magnetic permeability, while maintaining a high inductance value at a high current.

The first and second internal coil patterns 120 are formed in spiral shapes on opposing surfaces of the substrate 110 outwardly of the through hole. However, without being limited thereto, the first and second internal coil patterns 120 may be stacked on one surface of the substrate 110. Also, if necessary, the first and second internal coil patterns 120 may have various shapes other than a spiral shape, such as a circular shape, a polygonal shape, or an irregular shape. The first and second internal coil patterns 120 may include silver (Ag) or copper (Cu).

End portions of the first and second internal coil patterns 120 may be aligned with edges of the substrate 110. Thus, when the magnetic body 130 encloses the substrate 110 on which the first and second internal coil patterns 120 are formed, the through hole of the substrate 110 is filled with the magnetic body 130 and used as a core, and end portions of the first and second internal coil patterns 120 may be exposed to opposing side surfaces of the magnetic body 130.

The magnetic body 130 may be formed of ferrite or a metal-polymer composite. The metal-polymer composite may include metal particles having a diameter ranging from 100 nm to 90 μm and a polymer in which the metal particles are dispersed. The metal particles may be surrounded by a phosphate insulating layer. As the metal particles, metal magnetic powder particles having different sizes may be used. This allows the power inductor 100 to secure high magnetic permeability. The polymer may include an epoxy, a polyimide (PI), or a liquid crystal polymer (LCP).

Before the substrate 110, on which the first and second internal coil patterns 120 are formed, is enclosed within the magnetic body 130, an insulating layer (not shown) may be formed to cover the surfaces of the first and second internal coil patterns 120 in order to insulate the first and second internal coil patterns 120 and the magnetic body 130 from each other. Alternatively, if the magnetic body 130 is formed as a metal-polymer composite including metal particles covered with a phosphate insulating layer, the insulating layer covering the surfaces of the first and second internal coil patterns 120 may be omitted.

The magnetic body 130 may be formed through a molding scheme using a thermosetting resin containing metal magnetic powder or a thin film type scheme using stacked metal composite sheets.

The first external electrode 142 and the second external electrode 144 are formed on opposite end surfaces of the magnetic body 130 such that the first external electrode 142 and the second external electrode 144 are connected to end portions of the first and second internal coil patterns 120. The first external electrode 142 may be electrically connected to an end portion of one of the first and second internal coil patterns 120 exposed to one end surface of the magnetic body 130. The second external electrode 144 may be electrically connected to an end portion of the other of the first and second internal coil patterns 120 exposed to the other end surface of the magnetic body 130.

The first external electrode 142 and the second external electrode 144 each may include a cured conductive paste layer connected to end portions of the first and second internal coil patterns 120 and a plating layer plated on the cured conductive paste layer. The cured conductive paste layer may include silver (Ag). The plating layer may include nickel (Ni) or tin (Sn). The plating layer may serve to enhance bonding characteristics or soldering characteristics of the first external electrode 142 and the second external electrode 144.

The anti-plating layer 150 may cover the magnetic body 130 between the first external electrode 142 and the second external electrode 144. The anti-plating layer 150 may cover the entire surface of the magnetic body 130 excluding the first external electrode 142 and the second external electrode 144. The anti-plating layer 150 may include an organic-inorganic hybrid composite including an inorganic silica sol and an organic silane coupling agent. The inorganic silica sol may be prepared by hydrolyzing and condensation-polymerizing silica with tetraethylorthosilicate. Also, the anti-plating layer 150 may further cover a portion of the cured conductive paste layer forming the first external electrode 142 and the second external electrode 144.

As for the anti-plating layer 150, after a preliminary power inductor, an individual chip, is obtained through a dicing method, polishing is performed to round off outer corners of the separated individual chips, and during the polishing, metal particles of coarse powder contained in the magnetic body 130 are exposed by a polishing unit and a phosphate insulating layer of the exposed metal particles is stripped away. Here, the anti-plating layer 150 may serve to prevent plating from spreading to the surface of the magnetic body 130 on which the first external electrode 142 and the second external electrode 144 are not formed during plating performed to form the first external electrode 142 and the second external electrode 144.

Forming of the anti-plating layer 150 and forming of the first external electrode 142 and the second external electrode 144 may include forming a cured conductive paste layer on each of the opposing end surfaces of the magnetic body 130 such that the cured conductive paste layers are connected to the end portions of the first and second internal coil patterns 120, forming an anti-plating layer 150 covering the magnetic body 130 in which the cured conductive paste layer is not formed, and forming a plating layer on each of the cured conductive paste layers.

In forming the cured conductive paste layer, after silver paste is applied, the silver paste may be cured. In forming the plating layer the cured conductive paste layer may be plated with nickel or tin. The anti-plating layer 150 may be formed to further cover a portion of the cured conductive paste layer.

The anti-plating layer 150 may be formed to cover the entire surface of the magnetic body 130 excluding the first external electrode 142 and the second external electrode 144. The anti-plating layer 150 may include an organic-inorganic hybrid composite formed of an inorganic silica sol and an organic silane coupling agent.

In order to prepare a hybrid composite including silica, an organic-inorganic hybrid composite, silica may be hydrolyzed and condensation-polymerized with tetraethylorthosilicate to prepare a colloidal silica sol, the prepared silica sol, ethanol, and water are mixed at a weight ratio of 1:1:1, stirred for one hour, and adjusted to have a pH sufficient to allow silica to be stably dispersed by using a nitric acid ($HNO_3$). Thereafter, a silane coupling agent is added at a predetermined molarity, and stirred for 24 hours at room temperature, and here, a cross-linking agent may be added in a 0.5 mole ratio of the silane coupling agent during stirring.

The silane coupling agent may be glycidyloxypropyl-triethoxysilane: (GPTES) or glycidyloxypropyl-trimethoxysilane (GPTMS). The cross-linking agent corresponding to a hardener may be ethylene diamine.

Physical properties such as states or film strength according to various conditions of hybrid composites including silica may be known with reference to Table 1 to Table 3 below.

Hardness, among the physical properties of coating, was measured through a pencil hardness method, and adhesion was measured through a contact evaluation method using 3M tape based on ASTM D3359. The pencil hardness method is a method of evaluating hardness of coating according to whether a surface is damaged by inserting a pencil for pencil hardness measurement in the Mitsubishi pencil hardness tester 221-D at 45° and pushing the pencil by applying a predetermined load of 1 kg thereto. As a pencil, a product of the Mitsubishi Corporation was used.

As for evaluation of adhesion, a cured coating was scratched to have a checkerboard shape of 11×11 at intervals of 1 mm by a cutter, 3M tape was subsequently tightly adhered thereto and rapidly removed. The number of fragments (chips) of the coating remaining on a slide glass was evaluated.

Table 1 show the evaluation results of states, pencil hardness, and adhesion of hybrid composites including silica according to embodiments of the present disclosure based on pH.

Hybrid composites including silica prepared by adding 0.1 mol/l of glycidyloxypropyl-triethoxysilane to 5 wt % of silica solution and adjusting pH of the compounds with a nitric acid were deposited on disengaged slide glass and dried at 80° C. for 24 hours. Thereafter, physical properties of the coating were evaluated.

TABLE 1

| No. | pH | Sol state | Pencil hardness | Adhesion |
|---|---|---|---|---|
| 1 | 2 | gelated | — | — |
| 2 | 3 | Transparent solution | 4 | 32 |
| 3 | 4 | Transparent solution | 7 | 115 |
| 4 | 5 | Transparent solution | 6 | 94 |
| 5 | 6 | Transparent solution | 6 | 91 |
| 6 | 7 | Transparent solution | 5 | 78 |
| 7 | 8 | Transparent solution | 4 | 25 |
| 8 | 9 | gelated | — | — |
| 9 | 10 | gelated | — | — |

As illustrated in Table 1, when pH was less than 3 and more than 8, the hybrid composites including silica were gelated and opaque due to severe cohesion, while when pH ranged from 3 to 7, the hybrid composites including silica were transparent (sol state), exhibiting excellent dispersion stability.

In evaluation of hardness and adhesion of the coating, it was confirmed that the hardness and adhesion characteristics of the coating were excellent with a pH ranging from 4 to 6.

Table 2 shows evaluation results of states, pencil hardness, and adhesion according to concentration of a silane coupling agent of the hybrid composites including silica according to an embodiment of the present disclosure.

Hybrid composites including silica prepared by adding various molarities of glycidyloxypropyl-triethoxysilane to 5 wt % of silica solution and adjusting a final pH to 4 with a nitric acid were deposited on disengaged slide glass and dried at 80° C. for 24 hours. Thereafter, physical properties of the coating were evaluated.

TABLE 2

| No. | Molarity (mol/l) | Sol state | Pencil hardness | Adhesion |
|---|---|---|---|---|
| 1 | 0.01 | Transparent solution | 2 | 6 |
| 2 | 0.02 | Transparent solution | 3 | 18 |
| 3 | 0.03 | Transparent solution | 4 | 29 |
| 4 | 0.05 | Transparent solution | 5 | 74 |
| 5 | 0.09 | Transparent solution | 7 | 114 |
| 6 | 0.12 | Transparent solution | 8 | 120 |
| 7 | 0.14 | Transparent solution | 8 | 119 |
| 8 | 0.17 | gelated | — | — |
| 9 | 0.20 | gelated | — | — |

As illustrated in Table 2, when the molarity of glycidyloxypropyl-triethoxysilane exceeded 0.14 mol/l, the hybrid composites including silica were gelated and opaque due to severe cohesion, while when the molarity was 0.14 mol/l or less, the hybrid composites including silica were transparent (sol state), exhibiting excellent dispersion stability.

However, it was confirmed that hardness and adhesion of the coating were weak when the molarity of glycidyloxypropyl-triethoxysilane was 0.09 mol/l or less, but excellent when the molarity of the glycidyloxypropyl-triethoxysilane ranged from 0.09 to 0.14 mol/l.

Table 3 shows evaluation results regarding degree of plating spreading of the hybrid composites including silica according to an embodiment of the present disclosure according to concentration of the silane coupling agent.

Hybrid composites including silica prepared by adding various molarities of glycidyloxypropyl-triethoxysilane to 5 wt % of silica solution and adjusting a final pH to 4 with a nitric acid were applied to a surface of the magnetic body 130 of the power inductor 100 to form a coating, and plating was subsequently performed thereon to evaluate whether a plating layer was formed on the surface of the magnetic body 130 of the power inductor 100.

TABLE 3

| No. | Molarity (mol/l) | Frequency of formation of plating layer on surface of magnetic body (%) |
|---|---|---|
| 1 | 0.01 | 45 |
| 2 | 0.05 | 24 |
| 3 | 0.09 | 2 |
| 4 | 0.14 | 0 |
| 5 | 0.20 | 87 |

As illustrated in Table 3, it can be seen that the frequency of formation of a plating layer on the surface of the magnetic body 130 of the power inductor 100 was lowest when molarity of glycidyloxypropyl-triethoxysilane having excellent hardness and adhesion properties of coating ranged from 0.09 to 0.14 mol/l. This is determined to result from the fact that, since the coating is sufficiently maintained with respect to frictional force generated during a plating operation, the coating formed of the hybrid composites including silica according to an embodiment of the present disclosure serves to suppress formation of a plating layer on the surface of the magnetic body 130 of the power inductor.

As set forth above, according to exemplary embodiments of the present disclosure, since the anti-plating layer is provided to cover portions, excluding external electrodes, of the surface of the magnetic body including the external electrodes, a degradation of reliability due to the spreading of plating solution during plating performed to form the external electrodes may be prevented. Thus, the power inductor having an enhanced production yield may be provided.

In addition, according to exemplary embodiments of the present disclosure, since the anti-plating layer is formed to cover portions, excluding external electrodes, of the surface of the magnetic body including the external electrodes, a degradation of reliability due to the spreading of the plating solution during the plating operation for forming the external electrodes may be prevented. Thus, the method of manufacturing a power inductor having enhanced production yield may be provided.

While exemplary embodiments have been shown and described above, it will be apparent to those skilled in the art that modifications and variations could be made without departing from the scope of the present invention as defined by the appended claims.

What is claimed is:

1. A power inductor comprising:

a substrate having a through hole in a central portion thereof;

a first internal coil pattern and a second internal coil pattern each having a spiral shape and provided on opposite surfaces of the substrate outwardly of the through hole;

a magnetic body enclosing the substrate on which the first internal coil pattern and the second internal coil pattern are provided, end portions of the first internal coil pattern and the second internal coil pattern being exposed to opposite end surfaces thereof;

a first external electrode and a second external electrode provided on the opposite end surfaces of the magnetic body to be connected to the end portions of the first internal coil pattern and the second internal coil pattern, respectively; and an anti-plating layer covering the magnetic body between the first external electrode and the second external electrode, wherein the anti-plating layer covers a surface of the magnetic body without covering a surface of the magnetic body covered by the first or second external electrode, wherein each of the first external electrode and the second external electrode includes:

a cured conductive paste layer connected to the first internal coil pattern or the second internal coil pattern; and a plating layer plated on the cured conductive paste layer, and wherein the anti-plating layer further covers a portion of the cured conductive paste layer.

2. The power inductor of claim 1, wherein the magnetic body includes a ferrite or a metal-polymer composite.

3. The power inductor of claim 2, wherein the metal-polymer composite includes:

metal particles having a diameter ranging from 100 nm to 90 μm; and a polymer in which the metal particles are dispersed.

4. The power inductor of claim 3, wherein the metal particles are covered with a phosphate insulating layer.

5. The power inductor of claim 1, wherein the anti-plating layer includes an organic-inorganic hybrid composite including an inorganic silica sol and an organic silane coupling agent.

6. A power inductor comprising:

a substrate having a through hole in a central portion thereof;

a first internal coil pattern and a second internal coil pattern each having a spiral shape and provided on opposite surfaces of the substrate outwardly of the through hole;

a magnetic body enclosing the substrate on which the first internal coil pattern and the second internal coil pattern are provided, end portions of the first internal coil pattern and the second internal coil pattern being exposed to opposite end surfaces thereof;

a first external electrode and a second external electrode provided on the opposite end surfaces of the magnetic body to be connected to the end portions of the first internal coil pattern and the second internal coil pattern, respectively; and an anti-plating layer covering the magnetic body between the first external electrode and the second external electrode, wherein the anti-plating layer includes an organic-inorganic hybrid composite including an inorganic silica sol and an organic silane coupling agent.

* * * * *